United States Patent [19]

Reed

[11] 4,448,230

[45] May 15, 1984

[54] NAIL HOLDING HAMMER

[76] Inventor: Claude E. Reed, 7400 N. Adams Rd., North Adams, Mich. 49262

[21] Appl. No.: 359,569

[22] Filed: Mar. 18, 1982

[51] Int. Cl.[3] ..... B25C 1/00
[52] U.S. Cl. ..... 145/30 A
[58] Field of Search ..... 145/30 A, 30 R

[56] References Cited

U.S. PATENT DOCUMENTS

| | | | |
|---|---|---|---|
| 519,033 | 5/1894 | Capewell | 145/30 R |
| 1,258,053 | 3/1918 | Starrett | 145/30 R |
| 2,597,876 | 5/1952 | Kurkjian | 145/30 A |
| 3,543,821 | 12/1970 | Johnson | 145/30 A |
| 3,987,828 | 10/1976 | Matheis | 145/30 A |
| 4,367,778 | 1/1983 | Bradbury | 145/30 R |

FOREIGN PATENT DOCUMENTS

| | | | |
|---|---|---|---|
| 166412 | 12/1955 | Australia | 145/30 R |
| 2039815 | 8/1980 | United Kingdom | 145/30 A |

*Primary Examiner*—Frederick R. Schmidt
*Assistant Examiner*—J. T. Zatarga
*Attorney, Agent, or Firm*—Beaman & Beaman

[57] ABSTRACT

The invention relates to nail holding hammers and utilizes a socket formed in the hammer head adjacent the nail driving surface for receiving the headed end of a nail. A magnet within the socket retains the nail therein, and spaced lugs formed on the head define a nail shank support for the nail outer end. The socket axis, magnet surface, and nail supporting notch are oriented to maintain the length of the nail perpendicular to the hammer nail driving surface insuring that the nail will be set in the direction to be driven.

1 Claim, 3 Drawing Figures

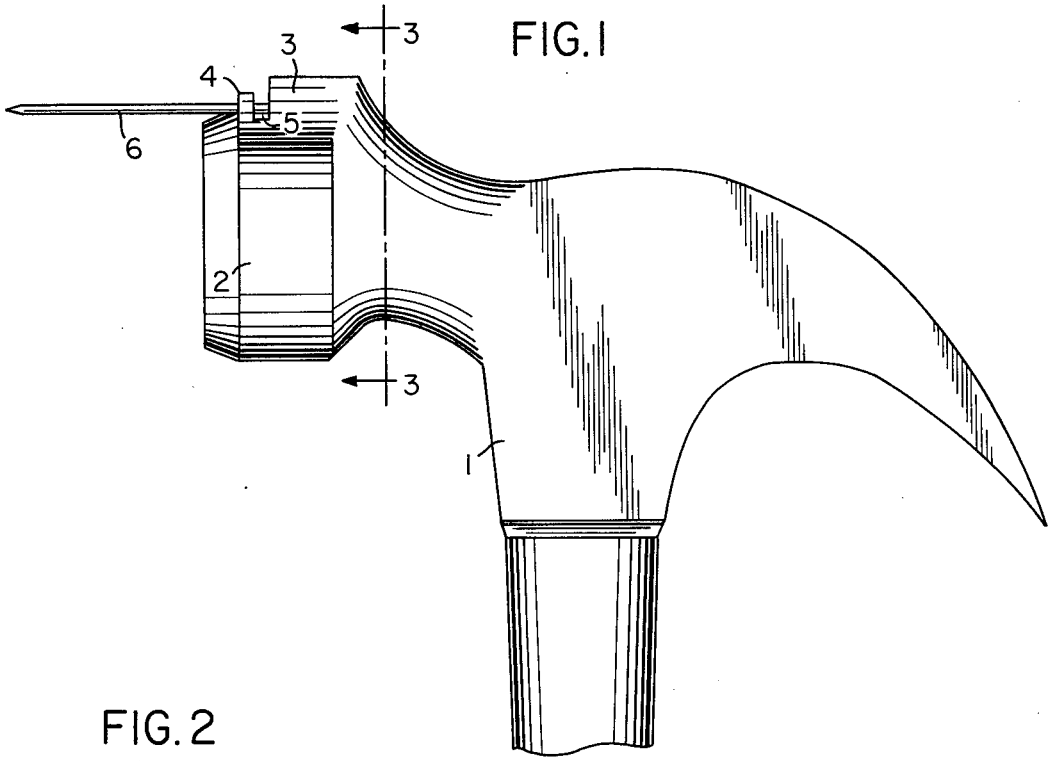
FIG. 1
FIG. 2
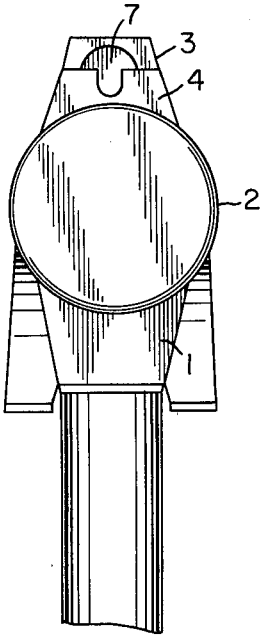
FIG. 3
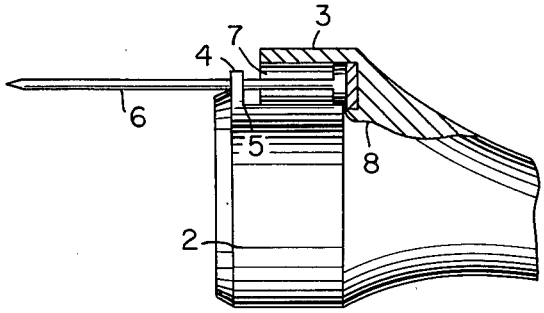

NAIL HOLDING HAMMER

This invention relates to hammers. References cited in the file of this patent;

U.S. Pat. No. 976,679 Morrison—Nov. 22, 1910

U.S. Pat. No. 1,209,507 Bostock—Sept. 1, 1914

U.S. Pat. No. 1,742,032 Gregersen—Dec. 31, 1929

The object of the invention is to provide a hammer equiped with a novel and improved means for holding a nail in position while effecting the initial starting of the nail, without the use of the fingers, when the hammer is being used by a person with one hand or when the hand that is not grasping the hammer, is being used to hold and align a board, or other, like material, while starting a nail.

The hammer being specifically useful in starting nails in inaccessible places, or at extended points and heights beyond the normal proximity of the person using the hammer.

A further object of the invention is to provide a nail holding device for hammers which is so constructed and arranged as to readily receive and hold the nail to be started and which will not interfere with the ordinary use of the hammer and will not present any disruptive resistance to disconnection from the nail, by the hand that holds the hammer, after the nail has been securely set.

With the above and other objects in view, as will appear as the nature of the invention is better understood, the invention consists in a novel, construction and combination of parts, of a nail holding embodiment as will be hereinafter illustrated, described and explained in the accompanying drawings, wherein:

FIG. 1 is a view in side elevation of the hammer head constructed in accordance with the invention.

FIG. 2 is a front elevational view.

FIG. 3 is a detail, partially sectional view illustrating the nail retaining socket.

Referring now to the drawings, in which like characters of reference indicate corresponding parts, FIG. 1 the hammer head 1, may be cast or forged or machined or partially machined of suitable material depending on the quality of tool to be produced.

Arranged in the upper face of poll 2 and slightly recessed back from the striking face of poll 2 is formed integrally with the hammer head a projection 3, this projection is further formed with a central bore or socket 7, FIG. 2 said bore or socket, being for the reception of the head of nail 6, as shown in FIG. 3. In alignment with and at the end of bore or socket 7, FIG. 2 is a magnet 8, FIG. 3 which draws to it and holds in abutment to it the nail head, as shown in FIG. 3. The projection 3, is further formed, lateral to and toward the striking face of poll 2, with nail shank support lugs 4, shaped as is illustrated in FIG. 2. The projection 3 and the support lugs 4, are separated by a milled, machined, or otherwise formed slot 5, FIG. 1, which receives the head of nail 6, which is inserted at slot 5, and then is pushed backward into bore or socket 7, FIG. 3 until it seats and abuts against magnet 8, FIG. 3 which holds nail 6, securely in place regardless of the position or attitude of hammer head.

Once the nail is driven and embedded into a piece of wood or other receptive material by a solid blow by the user, the hammer head further may be easily separated from the started nail by the user, without any disruptive resistance to the started nail by the user of the tool, pulling backward and downward on the hammer handle resulting in the separation of the hammer head and the started nail after which, the nail may be driven in by the conventional means by the user, the unique and novel improvements being such that they do not interfere with the normal use of the hammer in the conventional manner.

It is appreciated that various modifications to the inventive concepts may be apparent to those skilled in the art without departing from the spirit and scope of the invention.

What is claimed as new and useful is:

1. In a nailing hammer having a handle, a head affixed to the handle, a poll defined on the head having a circumference and defining a flat nail driving surface, the improvement comprising an elongated socket defined in the head at the poll adjacent the poll circumference and having an axis substantially perpendicular to the poll nail driving surface, said socket having an open end disposed toward the poll circumference and a closed end axially spaced from said open end a distance significantly greater than the axial dimension of the head of a nail to be retained within the socket, a permanent magnet within said socket defining said closed end thereof having a nail head engaging surface substantially parallel to the poll nail driving surface, a pair of spaced nail holing lugs defined upon the poll adjacent the circumference thereof spaced from said socket open end a distance greater than the axial dimension of the head of a nail to be retained within the socket and laterally offset with respect to said socket axis whereby said lugs define a nail receiving notch for receiving the shank of a nail whose head is received within said socket and held against said magnet, said notch and magnet nail engaging surface mounting the length of a retained nail substantially perpendicular to the poll nail driving surface permitting the nail to be started in the direction it is to be driven.

* * * * *